United States Patent [19]

Waskelo

[11] Patent Number: 4,789,161

[45] Date of Patent: Dec. 6, 1988

[54] PROPEL AND CATCH GAME

[76] Inventor: Mark A. Waskelo, 252 Seaside Ave., Stamford, Conn. 06902

[21] Appl. No.: 65,672

[22] Filed: Jun. 22, 1987

Related U.S. Application Data

[63] Continuation-in-part of Ser. No. 888,868, Jul. 24, 1986, abandoned.

[51] Int. Cl.[4] ..... G09B 59/00; G09B 67/00

[52] U.S. Cl. ..... 273/327; 273/26 B; 273/67 R; 273/346; 273/412; 273/DIG. 30

[58] Field of Search ..... 273/318, 323, 324, 346, 273/412, 58 A, 67 R, 72 R, DIG. 30, 327, 26 B

[56] References Cited

U.S. PATENT DOCUMENTS

| | | | |
|---|---|---|---|
| 1,546,483 | 7/1925 | Fegan | 273/58 A |
| 2,099,521 | 11/1937 | Herkimer et al. | 273/72 R |
| 3,169,019 | 2/1965 | Genjack | 273/323 X |
| 4,303,247 | 12/1981 | Fain | 273/324 |
| 4,354,679 | 10/1982 | Steinmetz | 273/58 A |

*Primary Examiner*—William H. Grieb

[57] ABSTRACT

This invention is essentially a toss and catch game, for recreation, exercise, sport, physical therapy, socialization, relaxation, enjoyment, or the like, or any combination thereof, in which a hand-held propel and catch device is utilized by one player to toss a projectile to another player, who catches the projectile with a like propel and catch device by making contact therewith. A cushioned portion of the upper propel and catch device is substantially covered with one component and the projectile is substantially covered with the other component of a two component fastening system, whereby the components are releasably adherent to each other upon contact. In the preferred embodiment, the propel and catch device includes an elongated, flexible handle which facilitates release of the projectile therefrom when sufficient manual motion is applied by a player in the act of tossing the projectile while gripping the lower handle area of the propel and catch device, while the projectile is spherical and of the necessary size, weight, shape, structure, and composition to facilitate its release from, travel to, and adherence with the propel and catch device of the opposing player.

7 Claims, 1 Drawing Sheet

PROPEL AND CATCH GAME

This is a continuation-in-part of application Ser. No. 06/888,868, filed July 24, 1986, now abandoned.

SUMMARY

This invention relates generally to games and more specifically to toss and catch games.

It is a general object of this invention to provide apparatus for a propel and catch activity, whereby a hand-held propelling device is utilized by one player to toss a projectile to another player, who catches the projectile with a like hand-held propel and catch device.

It is a further object of this invention to provide in combination a propel and catch device and a projectile, including means for catching the projectile, wherein the surface an enlarged upper portion of the propel and catch device is substantially covered with one component and the surface of the projectile is substantially covered with the other component of a two component fastening system, wherein the first component includes a plurality of loop elements projecting therefrom and the second component includes a plurality of hook elements projecting therefrom, whereby the first and second components are releasably adherent to each other upon contact. The propel and catch device includes means for propelling the projectile wherein the propel and catch device includes an elongated, flexible handle which facilitates the release of the projectile when sufficient manual motion is applied by a player in the act of tossing the projectile while gripping the lower handle area of the propel and catch device. The projectile is also of the necessary size, weight, shape, structure, and composition to facilitate its release from, travel to, and adherence with the propel and catch device. In essence, the propel and catch device and projectile are compatible with each other and have an overall balance of general mechanical properties for facilitating the propel and catch activity.

It is a further object of this invention to provide apparatus for a propel and catch activity, wherein the purpose of this activity is recreation, exercise, sport, physical therapy, socialization, relaxation, enjoyment, or the like, or any combination thereof.

It is a further object of this invention that players utilizing this apparatus derive physical and mental benefits related to fitness, challenge, competition, strategy, development, conditioning, improvement, or the like, or any combination thereof, inherent in the execution of this activity.

It is still a further object of this invention to provide apparatus that enables players to utilize, develop, enhance, or otherwise experience exertion, precision, skill, coordination, concentration, stamina, endurance, or the like, or any combination thereof, required in the execution of this activity.

BRIEF DESCRIPTION OF THE DRAWINGS

Other features and advantages of this invention will be apparent and understood by reference to the following description taken in connection with the accompanying drawings, wherein.

DETAILED DESCRIPTION OF THE PREFERRED EMBODIMENT

Figure 1:
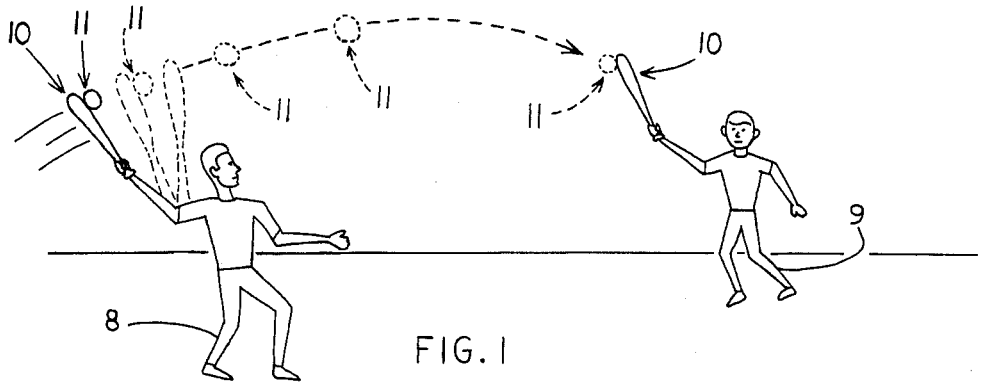
FIG. 1 is a perspective view showing two players utilizing propel and catch devices and a projectile in accordance with the invention.

Reference is now made to the drawings in detail. FIG. 1 shows two players 8, 9 holding like propel and catch devices 10 utilized for both tossing and catching the projectile 11. Player 8 is shown tossing the projectile to player 9, who catches the projectile with a propel and catch device by making contact therewith. Players are free to adopt any stance in combination with any wrist, arm, and bodily motion necessary to facilitate tossing and catching the projectile. While FIG. 1 show only two players, three or more players may be engaged in tossing and catching the projectile using like propel and catch devices. It is also conceivable that a person playing alone may derive satisfaction and enjoyment from tossing and catching the projectile in some fashion utilizing a propel and catch device.

Figure 2:
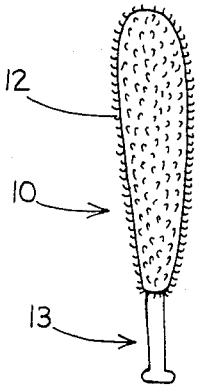
FIG. 2 is a plan view of the propel and catch device.

FIG. 2 shows a plan view of the propel and catch device 10 wherein 12 is an outer cover containing one component of a two-component fastening system and 13 are gripping means provided at the lower end of the propel and catch device 10.

Figure 3:
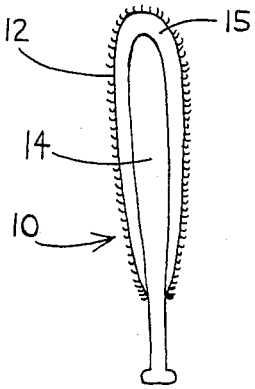
FIG. 3 is a lengthwise cross-sectional view of the propel and catch device.
Figure 4:
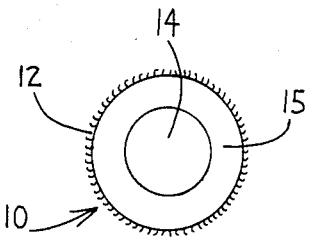
FIG. 4 is a cross-sectional view of the propel and catch device.

FIGS. 3 and 4 show two different cross-sectional views of the propel and catch device 10. The outer cover 12 of the propel and catch device is substantially covered with one component of a two-component fastening system. The propel and catch device includes an elongated, flexible handle 14 made of rubber, plastic, urethane, or like substance, or any combination thereof, which facilitates the release of the projectile when sufficient manual motion is applied by a player in the act of tossing the projectile while gripping the lower handle area of the propel and catch device. The propel and catch device includes a cushioned layer 15 between the handle 14 and outer cover 12 which facilitates the catching of the projectile. While the propel and catch device in its standard form is illustrated as similar in shape to a baseball bat, the propel and catch device is not necessarily limited to this shape, nor is the composition necessarily limited to that illustrated herein.

Figure 5:
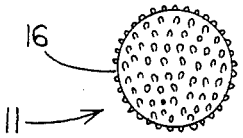
FIG. 5 is a plan view of the projectile.
Figure 6:
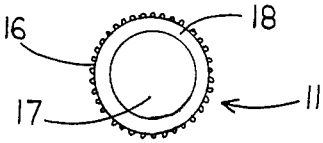
FIG. 6 is a cross-sectional view of one embodiment of the projectile.

FIG. 5 shows a plan view of the projectile 11 wherein an outer cover 16 is substantially covered with the other component of a two-component fastening system. The projectile is of the necessary size, weight, shape, structure, and composition to facilitate its release from, travel to, and adherence with the propel and catch device in the course of the toss and catch activity. In the most preferred embodiment of the projectile, the outer surface 16 surrounds and encloses a multitude of pellet-like objects, whereby the projectile partially collapses and adheres upon contact with the propel and catch device. While the projectile in its standard form is illustrated as spherical, the projectile is not necessarily limited to this shape, nor is the structure and composition necessarily limited to that described herein. For example, FIG. 6 shows a cross-sectional view of an alternative structure of the projectile 11 which provides the same general mechanical properties required of the projectile. In this alternative structure, the projectile includes a core 17 of the necessary weight to facilitate the projectile's release from, travel to, and adherence with the propel and catch device. The projectile may also include a layer 18 between the core 17 and outer surface 16 which would act as a cushioning agent in the entrapment of the projectile by the propel and catch device.

Figure 7:
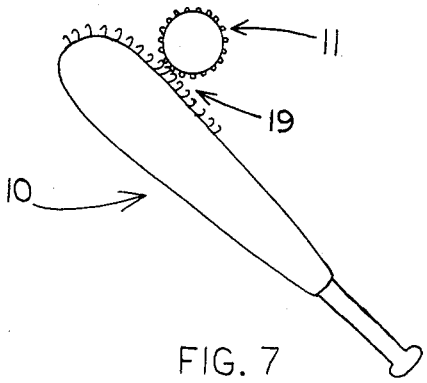
FIG. 7 is a diagram of the mode of adherence of the projectile to the propel and catch device.

FIG. 7 shows 19 as one of a multitude of points at which the projectile 11 releasably adheres to the propel and catch device 10, wherein at the point of contact, the surface of the propelling device containing one component and the surface of the projectile containing the other component of a two-component fastening system releasably engage with each other. While FIG. 7 shows the surface of the propelling device to contain hook-like formations and the surface of the projectile to contain loop-like formations, such formations may be reversed between the apparatus.

To further elaborate on the use of this apparatus as described and illustrated herein, it would be preferable to the players for the projectile to be entrapped by and released from the uppermost portion of the propel and catch device, as this would facilitate the most effective and efficient release therefrom, and entrapment thereby, in conjunction with the motions inherent in the act of propelling and entrapping the projectile.

From the foregoing, it should be readily apparent that suitable apparatus have been described for carrying out the desired end, whereby the propel and catch device and projectile are compatible with each other and have an overall balance of general mechanical properties for facilitating the propel and catch activity. However, it is to be understood that other modifications may be made to either the propel and catch device or projectile or both without departing from the spirit and scope of this invention, as defined by the appended claims.

I claim:

1. A propel and catch game comprising apparatus, in combination:

at least one hand-held, propel and catch device including:

an elongated, flexible handle which is adapted to be gripped by one hand but capable of manipulation with both hands by an individual playing said game; and enlarged catch means provided at an outward end of said handle for catching and propelling a projectile, said catch means including a cushioned inner portion, an outer cover, and fastening means over a substantial portion of at least one side of said outer cover, said fastening means comprising one component of a two component hook and loop fastening system; and a projectile adapted to be propelled and caught by said propel and catch device, said projectile including a resilient inner portion, an outer cover, and fastening meas over a substantial portion of said outer cover, said fastening means comprising the second component of said two component hook and loop fastening system.

2. The apparatus of claim 1 wherein gripping means is provided at the lower end of said handle of said propel and catch device.

3. The apparatus of claim 1 wherein said propel and catch device is similar in shape to a baseball bat.

4. The apparatus of claim 1 wherein said resilient inner portion of said projectile consists of a multitude of pellet-like objects, whereby said projectile partially collapses and adheres upon contact with said propel nd catch device.

5. The apparatus of claim 1 wherein said projectile includes a core of the necessary weight to facilitate said projectile's release from, travel to, and adherence with said propel and catch device.

6. The apparatus of claim 5 wherein said projectile includes a cushioned layer between said outer cover and said core to facilitate entrapment of said projectile by said propel and catch device.

7. The apparatus of claim 1 wherein said projectile is spherical in shape.

* * * * *